US007681417B2

(12) United States Patent
Hagihara et al.

(10) Patent No.: US 7,681,417 B2
(45) Date of Patent: Mar. 23, 2010

(54) HEAT-RESISTANT FABRIC AND GARMENT AND HEAT-RESISTANT GLOVE USING THE SAME

(75) Inventors: Akifumi Hagihara, 688, Nishi, Wakayama-Shi, Wakayama (JP) 640-8313; Hiromu Hayashi, Wakayama (JP); Yoshitada Kawaguchi, Wakayama (JP)

(73) Assignees: Hayashi Yarn Twisting Co., Ltd., Wakayama (JP); Akifumi Hagihara, Wakayama (JP)

( * ) Notice: Subject to any disclaimer, the term of this patent is extended or adjusted under 35 U.S.C. 154(b) by 332 days.

(21) Appl. No.: 11/922,272

(22) PCT Filed: May 18, 2006

(86) PCT No.: PCT/JP2006/309926

§ 371 (c)(1), (2), (4) Date: Dec. 14, 2007

(87) PCT Pub. No.: WO2006/134748

PCT Pub. Date: Dec. 21, 2006

(65) Prior Publication Data

US 2009/0019614 A1 Jan. 22, 2009

(30) Foreign Application Priority Data

Jun. 17, 2005 (JP) ..... 2005-178165
Oct. 25, 2005 (JP) ..... 2005-310420

(51) Int. Cl.
*D04B 7/34* (2006.01)

(52) U.S. Cl. ..... 66/174; 66/202; 2/167; 2/161.6

(58) Field of Classification Search ..... 66/202, 66/170–174, 196, 169 R; 2/2.5, 16, 167
See application file for complete search history.

(56) References Cited

U.S. PATENT DOCUMENTS 4,384,449 A * 5/1983 Byrnes et al. ..... 57/210

(Continued)

FOREIGN PATENT DOCUMENTS

JP 47-33272 U 12/1972

(Continued)

OTHER PUBLICATIONS

Encyclopedia of fibers, Maruzen Co., Ltd., Mar. 25, 2002, pp. 362, 619, 620, 670, 719, 766, 767, 768, 797, 1004 with the partial translation.

*Primary Examiner*—Danny Worrell
(74) *Attorney, Agent, or Firm*—Hamre, Schumann, Mueller & Larson, P.C.

(57) ABSTRACT

A heat-resistant fabric according to the present invention is a knitted or woven fabric including a heat-resistant fiber yarn and a fancy twist yarn. The heat-resistant fiber yarn is present more on one surface, and the fancy twist yarn is present more on the other surface. A heat-resistant glove according to the present invention is formed of a knitted fabric including a heat-resistant fiber yarn (11) and a fancy twist yarn (12). The knitted fabric is a knit, and the heat-resistant fiber yarn (11) is present more on an outer surface, and the fancy twist yarn (12) is present more on an inner surface. The heat-resistant fabric, a garment, and the heat-resistant glove have air permeability and good workability and are washable. Further, there is provided a heat-resistant fabric as a knitted or woven fabric including a heat-resistant fiber yarn and a fancy twist yarn, in which the heat-resistant yarn is arranged on a surface and the fancy twist yarn is arranged in a structure so as to allow much air to be contained. As a result, the heat-resistant fabric has high heat insulation, heat resistance, flame proofness, flame retardancy, and protection. Further, there are provided a garment and a heat-resistant glove using the above-described heat-resistant fabric.

18 Claims, 14 Drawing Sheets

U.S. PATENT DOCUMENTS

| | | | | | |
|---|---|---|---|---|---|
| 4,433,493 | A * | 2/1984 | Poisson | 66/202 |
| 4,470,251 | A * | 9/1984 | Bettcher | 57/230 |
| 4,750,324 | A * | 6/1988 | Tochacek et al. | 57/210 |
| 5,499,400 | A * | 3/1996 | Masuda et al. | 25/161.6 |
| 5,965,223 | A * | 10/1999 | Andrews et al. | 2/167 |
| 6,015,618 | A * | 1/2000 | Orima | 66/169 R |
| 6,161,400 | A * | 12/2000 | Hummel | 66/174 |
| 7,087,300 | B2 * | 8/2006 | Hanyon et al. | 428/364 |
| 2009/0019614 | A1 * | 1/2009 | Hagihara et al. | 2/16 |

FOREIGN PATENT DOCUMENTS

| | | | |
|---|---|---|---|
| JP | 48-5071 | U | 1/1973 |
| JP | 53-92402 | U | 7/1978 |
| JP | 5-54580 | U | 7/1993 |
| JP | 3048633 | U | 5/1998 |

* cited by examiner

Warp double weave

Weft double weave

HEAT-RESISTANT FABRIC AND GARMENT AND HEAT-RESISTANT GLOVE USING THE SAME

TECHNICAL FIELD

The present invention relates to a heat-resistant fabric having high heat insulation, heat resistance, flame proofness, and flame retardancy, and a garment and a heat-resistant glove using the same.

BACKGROUND ART

For work with high-temperature objects such as a welding operation like arc welding, a furnace operation in front of a blast furnace or the like, and cooking, heat-resistant gloves are necessary from a safety standpoint. A typical material for heat-resistant gloves for use in a thermally harsh operation is an animal skin. A firefighter's uniform also requires heat resistance. Further, materials for the interiors of vehicles such as a car and a train also need to have heat resistance, flame proofness, and flame retardancy.

Conventionally, making heat-resistant gloves or firefighter's uniforms by using a heat-resistant fiber such as an aramid fiber, a polybenzimidazole fiber, a polybenzoxazole fiber, a polybenzazole fiber, a polyamide imide fiber, a melamine fiber, and a polyimide fiber has been proposed (for example, Non-patent document 1 and Patent document 1). Non-patent document 1 describes that a firefighter's uniform is made of 95% of a meta-aramid fiber in terms of flame proofness and workability and 5% of a para-aramid fiber in terms of dimensional stability and prevention of shrinkage. Further, Patent document 1 describes that a glove is knitted from an aramid fiber yarn alone and a synthetic resin is fused by heating to a palm portion of the glove.

However, conventional heat-resistant gloves made of an animal skin have a problem in workability because fingers cannot be moved smoothly. Further, an animal skin is an inconvenient material in use since it does not have a function of absorbing sweat and is not washable. Conventional gloves made of a fabric of a heat-resistant fiber yarn alone have a problem in heat insulation. In arc welding, for example, when an arc falls on the gloves, the skin may be burned. In order to solve this problem, the fabric can be made thicker, which, however, results in another problem in workability because fingers cannot be moved smoothly, and an increase in cost. Further, in the case of firefighter's uniforms made with a heat-resistant fiber, an aluminum foil (including a coating) is formed on an outermost layer, a fabric of the heat-resistant fiber alone is formed inside thereof, and a non-woven fabric is arranged inside thereof for heat insulation. Accordingly, such firefighter's uniforms become heavy as a whole, and thus may lead to poor operation or injury to the human body. Further, in recent years, there is a need for garments having heat resistance and protection.

Non-patent document 1: "Encyclopedia of fiber", Maruzen Co., Ltd., Mar. 25, 2002, page 619

Patent document 1: Japanese Utility Model Registration No. 3048633

DISCLOSURE OF INVENTION

In order to solve the above-described conventional problems, the present invention provides a heat-resistant fabric as a knitted or woven fabric including a heat-resistant fiber yarn and a fancy twist yarn, in which the heat-resistant yarn is arranged on a surface and the fancy twist yarn is arranged in a structure so as to allow much air to be contained. As a result, the heat-resistant fabric has high heat insulation, heat resistance, flame proofness, flame retardancy, and protection. The present invention further provides a garment and a heat-resistant glove using the above-described heat-resistant fabric.

A heat-resistant fabric according to the present invention is a knitted or woven fabric including a heat-resistant fiber yarn and a fancy twist yarn. The heat-resistant fiber yarn is present more on one surface, and the fancy twist yarn is present more on the other surface.

A garment according to the present invention in part or in entirety includes the above-described heat-resistant fabric.

A heat-resistant glove according to the present invention is formed of a knitted fabric including a heat-resistant fiber yarn and a fancy twist yarn. The knitted fabric is a knit, and the heat-resistant fiber yarn is present more on an outer surface, and the fancy twist yarn is present more on an inner surface.

Another heat-resistant glove according to the present invention with a multilayer structure includes: on an inner side, a heat-resistant glove formed of a knitted fabric including a heat-resistant fiber yarn and a fancy twist yarn, wherein the knitted fabric is a knit, the heat-resistant fiber yarn is present more on an outer surface, and the fancy twist yarn is present more on an inner surface; and on an outer side, a glove formed of a heat-resistant fiber yarn. Both the gloves are fixed at fingertip points.

DESCRIPTION OF THE INVENTION

Figure 1A:
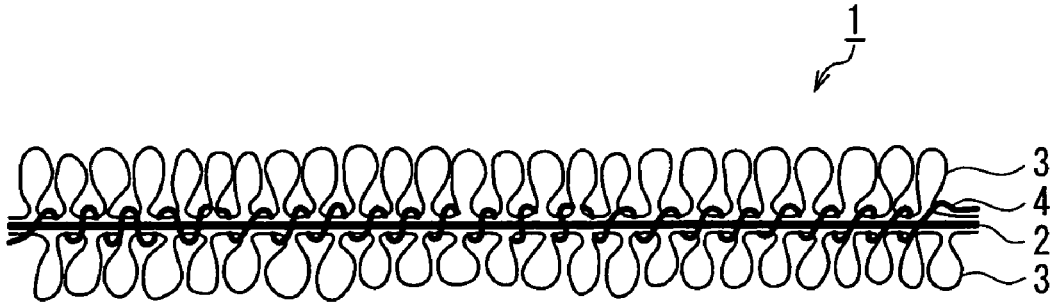
FIGS. 1A and 1B are a side view and a cross-sectional view, respectively, of a fancy twist yarn used in an example of the present invention.

According to a heat-resistant fabric and a heat-resistant glove of the present invention, a knitted or woven fabric is formed by using a heat-resistant fiber yarn and a fancy twist yarn so that the heat-resistant fiber yarn is present more on one surface and the fancy twist yarn is present more on the other surface. As a result, it is possible to contain much air in a structure, thereby providing a heat-resistant fabric having high heat insulation, heat resistance, flame proofness, flame retardancy, and protection. More specifically, since a fancy twist yarn includes many loops, a knitted fabric and a woven fabric using a fancy twist yarn allow much air to be contained in a structure. Since air has high heat insulation, the knitted fabric and the woven fabric have high heat insulation as well. Further, since the heat-resistant fiber yarn is present more on one surface, heat resistance, flame proofness, flame retardancy, and protection are achieved in this portion. In addition, the heat-resistant fabric and a garment and the heat-resistant glove using the same according to the present invention have air permeability and good workability and are washable.

According to the present invention, there is no limitation on the heat-resistant fiber, whether it be an inorganic fiber or an organic fiber, as long as it has a melting point or a decomposition point of about 350° C. or higher, and preferably 400° C. or higher. Preferably, the heat-resistant fiber is at least one selected from an aramid fiber (melting point or decomposition point of para-aramid: 480° C. to 570° C., melting point or decomposition point of meta-aramid: 400° C. to 430° C.), a polybenzimidazole fiber (glass transition temperature: 400° C. or higher), a polybenzoxazole fiber (melting point or decomposition temperature: 650° C.), a polybenzthiazole fiber (melting point or decomposition temperature: 650° C.), a polyamide imide fiber (melting point or decomposition temperature: 350° C. or higher), a melamine fiber (melting point or decomposition temperature: 400° C. or higher), a polyimide fiber (melting point or decomposition temperature: 350° C. or higher), a polyarylate fiber (melting point or decomposition temperature: 400° C. or higher), and a carbon fiber (melting point or decomposition temperature: 2000° C. to 3500° C.). These fibers can be processed easily into a knitted or woven fabric. A preferable fineness is about 118 to 5905 dtex (cotton count: 0.5 to 50). Each of these fibers can be used as a single yarn. Alternatively, a plurality of these fibers can be pulled parallel or twisted in use.

For example, it is preferable that the fancy twist yarn is formed of a core yarn, a loop yarn, and a holding yarn, and that the loop yarn is formed of at least one selected from cotton, rayon, hemp, wool, and an acrylic fiber. For the core yarn and the holding yarn, a polyester filament yarn can be used, for example. By overfeeding the loop yarn 2 to 6 times as much as the core yarn, loops are formed at random in all directions around the core yarn. The fancy twist yarn preferably has a fineness of about 118 to 11811 dtex (cotton count: 0.5 to 50). The fancy twist yarn can be used as a single yarn. Alternatively, a plurality of the fancy twist yarns can be pulled parallel or twisted in use.

The heat-resistant fabric is formed as a knitted or woven fabric with a multilayer structure in which a heat-resistant fiber yarn is present more on one surface and a fancy twist yarn is present more on the other surface. The knitted or woven fabric with this structure is at least one selected from a double knit, a double jersey, an interlock knit fabric, a double raschel, a double knitted fabric, a double cloth, a single jersey, and a smooth knitted fabric.

In the above-described structure, the loops of the loop yarn partially may protrude through the surface rich with the heat-resistant fiber yarn. In such a case, the loops appearing on the outer surface preferably are cut as cut pile. Consequently, when the heat-resistant glove is used as a work glove, the loops are kept from snagging on machine parts, resulting in improved safety in use.

The heat-resistant fabric, the garment, and the heat-resistant glove of the present invention have a thickness preferably of not less than 0.3 mm and not more than 3 mm, and more preferably of not less than 0.5 mm and not more than 2 mm. The heat-resistant glove has a weight per unit area preferably of not less than 0.09 g/cm$^2$, and more preferably of not less than 0.1 g/cm$^2$. When the thickness and the weight per unit area are within the above-mentioned ranges, flame resistance as well as heat shielding properties is improved. Since the garment does not require heat resistance as high as that of the glove, and a lightweight garment is more comfortable to wear, the garment preferably has a weight per unit area in a range of 300 to 700 g/m$^2$.

The fabric of the present invention is useful for, for example, outer garments such as a parka, a jumper, a coat, and a vest, an arm cover, an apron, a protective hood, a firefighter's uniform, protective clothing, work clothing, a fire cloth, and interior materials for vehicles such as a car and a train. Further, the fabric of the present invention is useful for a heat-resistant glove for work with high-temperature objects such as a welding operation like arc welding, a furnace operation in front of a blast furnace or the like, and cooking.

Hereinafter, a description will be given with reference to the drawings.

Figure 1B:
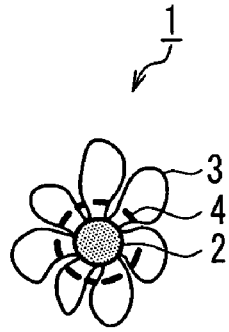

FIGS. 1A and 1B are a side view and a cross-sectional view, respectively, of a fancy twist yarn 1 used in an example of the present invention. The fancy twist yarn 1 is formed of a core yarn 2, a loop yarn 3, and a holding yarn 4 thereabove. The loop yarn 3 is formed of cotton, for example.

Figure 2A:
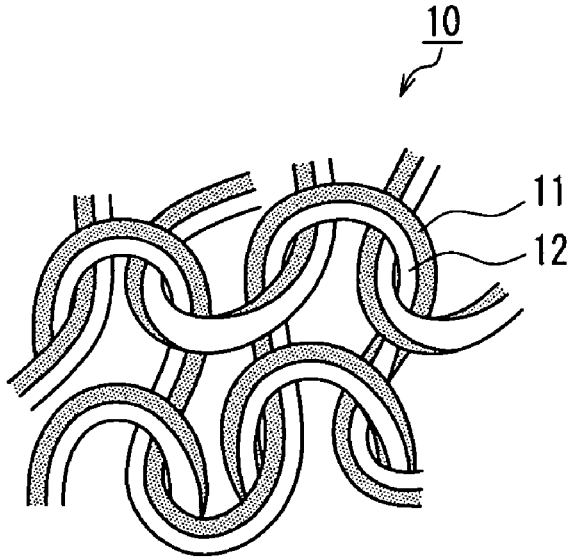
FIGS. 2A and 2B are structure diagrams of an interlock knitted fabric used in an example of the present invention.
Figure 2B:
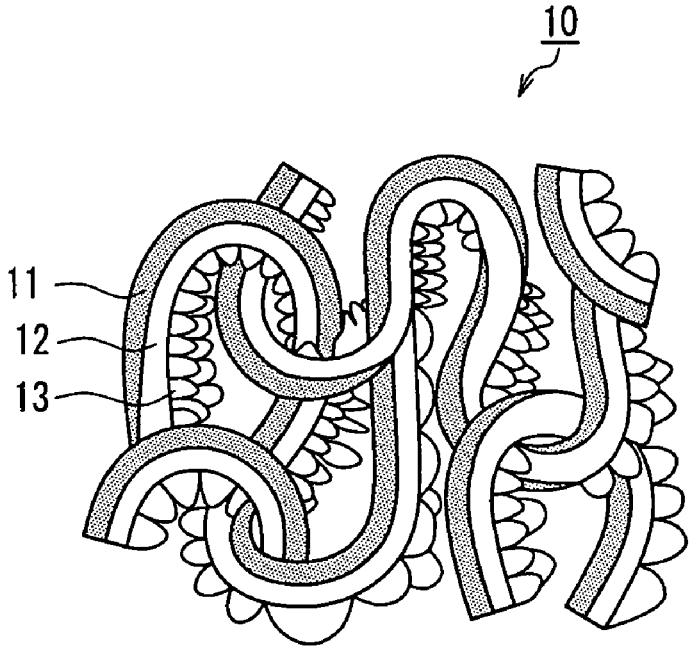

FIGS. 2A and 2B are structure diagrams of an interlock knitted fabric 10 used in an example of the present invention. As shown in FIG. 2A, a heat-resistant fiber yarn 11 and a fancy twist yarn 12 are pulled parallel, the heat-resistant fiber yarn 11 is arranged on a surface, and the fancy twist yarn 12 is arranged on a back surface. The fancy twist yarn 12 has many protruding loops 13, which are present more in an area ranging from an inner surface to the back surface of the interlock knitted fabric 10. This allows many spaces to be formed, resulting in a heat insulation effect. On the surface, the heat-resistant fiber yarn 11 is present more, resulting in heat resistance, flame proofness, and flame retardancy.

Although some of the loops 13 protrude also through the surface on a heat-resistant fiber yarn 11 side, these loops hardly affect heat resistance. Rather, since the loops 13 on the heat-resistant fiber yarn 11 side surface get burned by exposure to flames or on contact with a high-temperature object, an operator can become aware of danger. As described above, the loops 13 on the heat-resistant fiber yarn 11 side surface may be cut as cut pile.

The above-described knitted fabric is suitable for a heat-resistant glove. A glove may be knitted by using a glove knitting machine such as a fully automatic glove knitting machine manufactured by Shima Seiki Mfg., Ltd., for example.

Figure 3A:
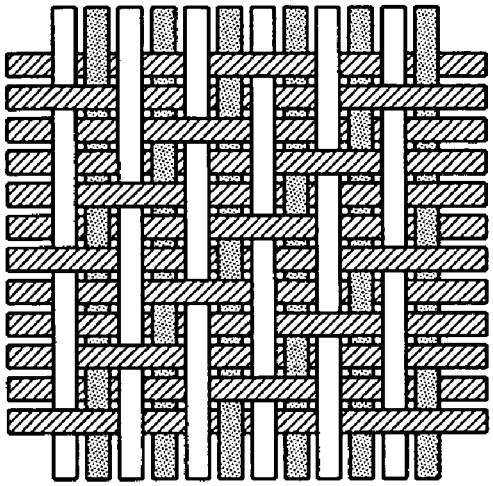
FIGS. 3A and 3B are structure diagrams of a warp double weave and a weft double weave, respectively, as examples of a double weave in another example of the present invention.
Figure 3B:
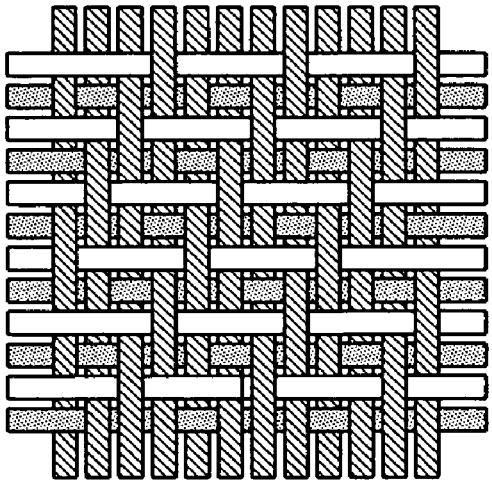

FIGS. 3A and 3B show examples of a double weave in another example of the present invention. FIGS. 3A and 3B are structure diagrams of a warp double weave and a weft double weave, respectively. A heat-resistant fiber yarn is arranged on a surface side of such a woven fabric, and a fancy twist yarn is arranged on a back surface side thereof.

Figure 11:
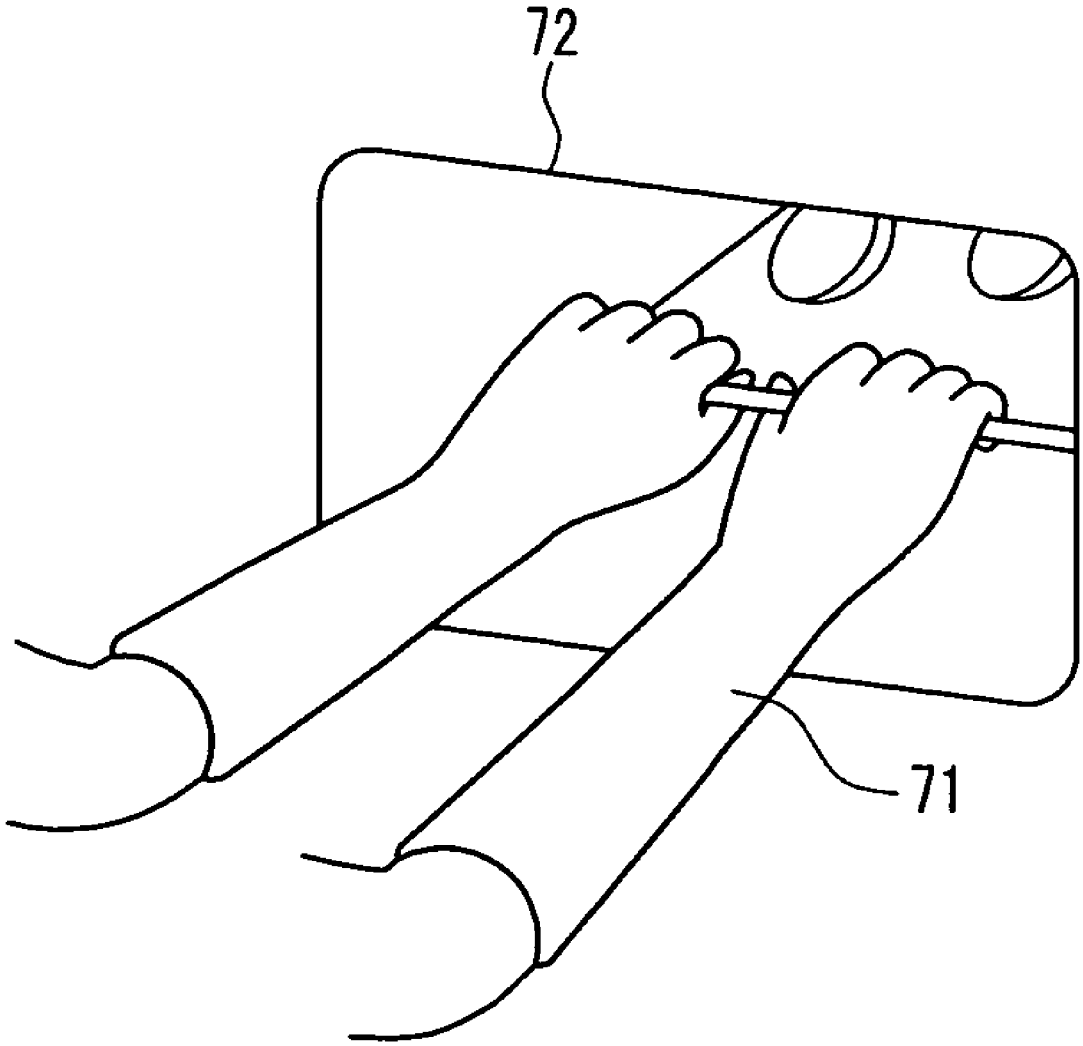
FIG. 11 is a diagram showing an example of use of long type heat-resistant gloves in an example of the present invention.

FIG. 11 shows an example of use of long type heat-resistant gloves 71 with long sleeve portions in an example of the present invention. These gloves are suitable for kitchen use in cooking and the like, and can prevent a burn even if an arm touches a heating portion of an oven 72.

EXAMPLE

Hereinafter, the present invention will be described more specifically with reference to the following examples.

Example 1

(1) Manufacture of Fancy Twist Yarn

A polyester multifilament textured yarn (manufactured by Toray Industries. Inc.) composed of 48 filaments with a total fineness of 83 dtex (75 denier) was used as a core yarn and a holding yarn, and a cotton yarn of 196.9 dtex (cotton count: 30) was used as a loop yarn. 3 single yarns of cotton were overfed at a rate 5 to 7 times as high as that of a single core yarn so as to be intertwined therewith, and at the same time as intertwining, the holding yarn was actually twisted from above the intertwined yarns at about 1000 turns/m. The thus obtained fancy twist yarn had protruding loops, each having an average length of 3 mm, and 70 loops per inch on average protruded at all angles in a 360° range as shown in FIGS. 1A and 1B. This fancy twist yarn had a fineness of 2511 dtex (cotton count: 2.3530, 2260 denier).

(2) Preparation of Heat-Resistant Fiber Yarn 8 or 9 commercially available spun yarns, "CONEX" (trade name) (meta-aramid fiber) manufactured by Teijin Ltd., of 295.3 dtex (cotton count: 20) were used.

(3) Knitting of Glove

Figure 4:
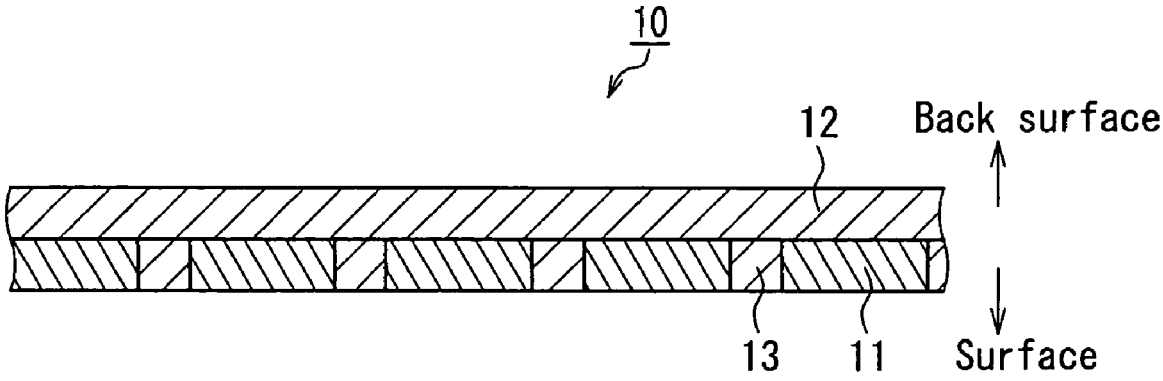
FIG. 4 is a schematic cross-sectional view of an interlock knitted fabric forming a heat-resistant glove obtained in an example of the present invention.

A glove was knitted by using a fully automatic glove knitting machine manufactured by Shima Seiki Mfg., Ltd. 60 wt % of a heat-resistant fiber yarn and 40 wt % of a fancy twist yarn were knitted into the glove. A knitted fabric structure is shown in FIGS. 2A and 2B. FIG. 4 is a schematic cross-sectional view of the interlock knitted fabric 10. The heat-resistant fiber yarn 11 was arranged on a surface side, and the fancy twist yarn 12 was arranged on a back surface side. Although the loops 13 mainly are present on the back surface side, they partially were exposed also on the surface side. The thus obtained single glove had a weight of 70.3 g. This weight is substantially the same as that of a heat-resistant glove formed of 100% of commercially available "CONEX" (meta-aramid fiber).

(4) Heat Resistance Test

Wearing the obtained heat-resistant work glove, an operator exposed the glove to fire of a lighter. Then, although the glove slightly got burned on its surface, it did not get hot inside. This showed that the glove had flame retardancy and heat resistance.

Further, when the glove was used in an arc welding operation, the glove did not get hot even when it was exposed to sparks (about 1200° C.) of welding. Further, the glove exhibited good workability without inhibiting a work operation due to its small thickness and air permeability. It was possible to wash the glove after the operation and to use it repeatedly.

Further, when the glove was used in a cooking operation of baking a pizza pie in a combustion furnace, the glove similarly exhibited high heat insulation, heat resistance, flame proofness, flame retardancy, air permeability, good workability, and good hygiene due to its washability.

Example 2

Figure 5A:
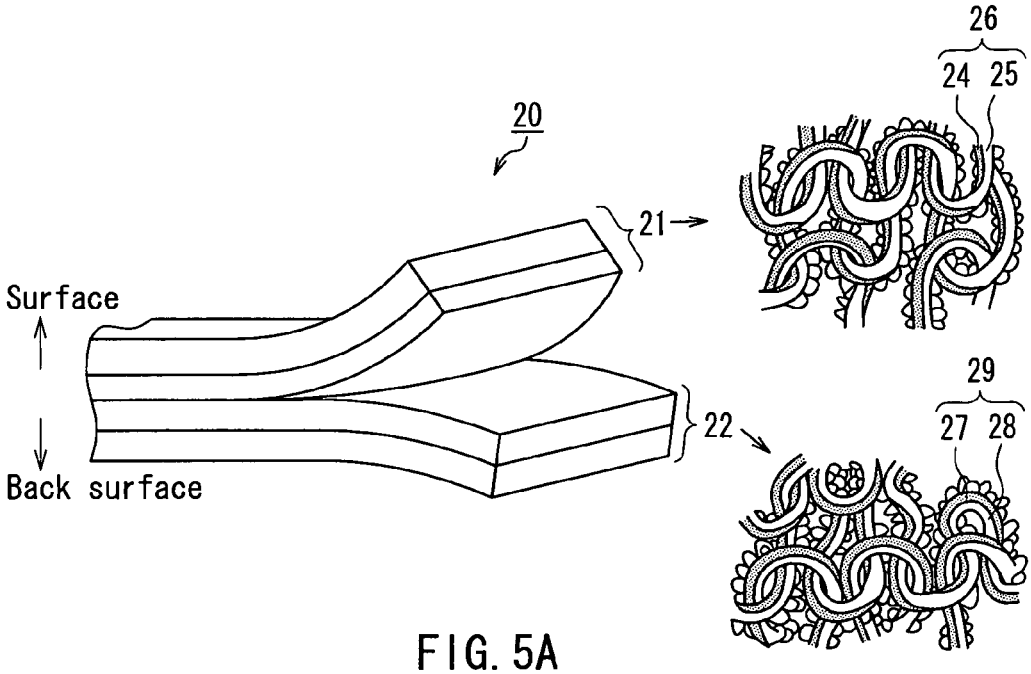
FIGS. 5A, 5B, and 5C are a schematic perspective view, a cross-sectional view, and an explanatory diagram showing bonded portions, respectively, of a heat-resistant glove with a four-layer structure.
Figure 5B:
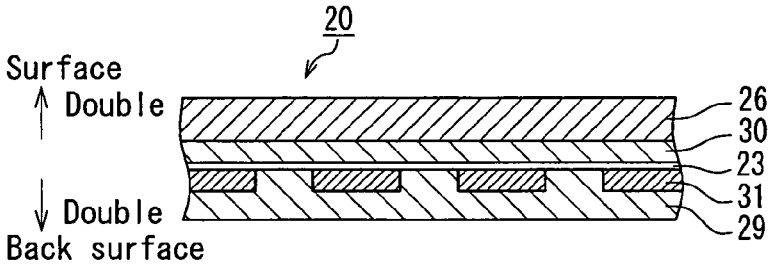
Figure 5C:
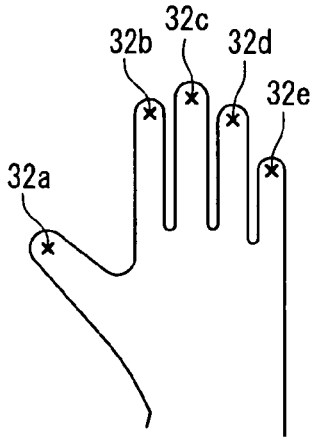

FIGS. 5A to 5C show an example of a heat-resistant glove with a four-layer structure. As shown in FIG. 5A, a glove 22 with a two-layer structure as in Example 1 was arranged on a back surface (skin side), and a glove 21 with a two-layer structure in which a surface yarn and a back surface yarn are both an aramid fiber yarn was arranged on an outer layer on a surface side. Reference numeral 24 denotes an aramid fiber yarn located on a surface of the glove 21, and 25 denotes an aramid fiber yarn located on a back surface of the glove 21. Reference numeral 26 denotes a knit structure formed of the aramid fiber yarns 24 and 25. For the aramid fiber yarns 24 and 25, 7 commercially available spun yarns, "CONEX" (trade name) (meta-aramid fiber) manufactured by Teijin Ltd., of 295.3 dtex (cotton count: 20) were used. The aramid fiber yarn 24 was an ordinary spun yarn with no loop, and the aramid fiber yarn 25 was a spun yarn with loops, each having an average length of 1.5 mm. A knit structure of the glove 22 with a two-layer structure on the back surface (skin side) was the same as that in Example 1. Note here that a fancy twist yarn 28 formed of cotton yarns has a fineness of 2511 dtex (cotton count: 2.3530, 2260 denier), and 5 spun yarns 27 of a meta-aramid fiber of 295.3 dtex (cotton count: 20) were used. Reference numeral 29 denotes the knit structure formed of the fancy twist yarn 28 and the aramid fiber yarn 27.

The above-described two gloves were overlapped and bonded to each other with a heat-resistant adhesive ("Three Bond 1212" (trade name) manufactured by Three Bond Co., Ltd.) applied to five fingertip points 32*a* to 32*e* shown in FIG. 5C. The single glove (for one hand) had a weight of 95 g.

FIG. 5B is a cross-sectional view of a heat-resistant glove 20 with a four-layer structure obtained as described above. From the surface side, the aramid fiber yarn 26, a layer 30 of small loops of the aramid fiber, an air layer 23, an aramid fiber layer 31, and a layer 29 of large loops of the fancy twist yarn formed of cotton yarns were formed in this order. The ratio between the thickness of the aramid fiber layer (surface) and that of the cotton layer (back surface) was about 2:1.

The heat-resistant glove with a four-layer structure exhibited higher heat resistance than that of the glove in Example 1. Further, no loop protruded through the surface of the glove, resulting in improved safety in use.

Example 3

Figure 6A:
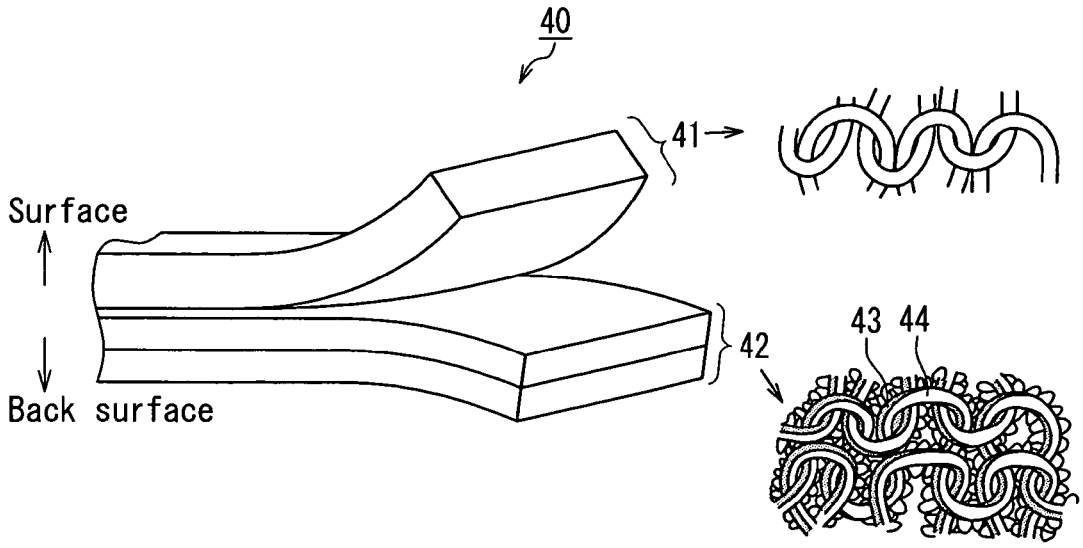
FIGS. 6A, 6B, and 6C an a schematic perspective view, a cross-sectional view, and an explanatory diagram showing bonded portions, respectively, of a heat-resistant glove with a three-layer structure.
Figure 6B:
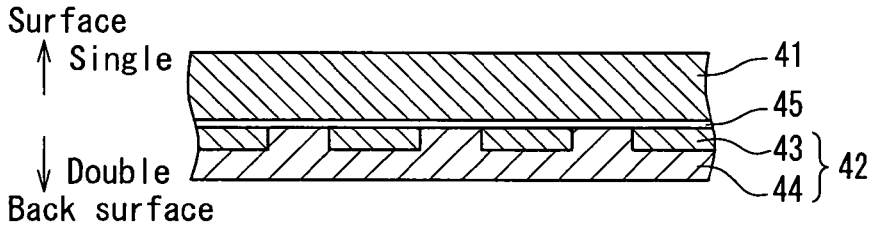
Figure 6C:
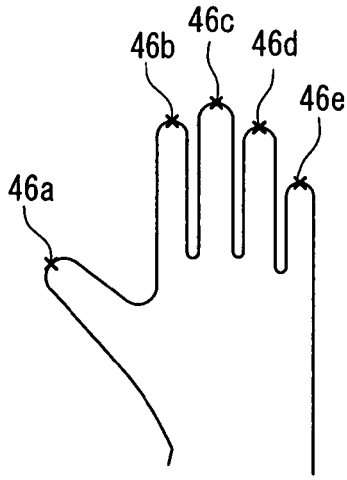

FIGS. 6A to 6C show an example of a heat-resistant glove with a three-layer structure. As shown in FIG. 6A, a glove 42 with a two-layer structure as in Example 1 was arranged on a back surface (skin side), and a glove 41 with a single-layer structure formed of an aramid fiber yarn was arranged on an outer layer on a surface side. For the glove 41, 10 meta-aramid fiber yarns of 295.3 dtex (cotton count: 20/1) as described above were used as an ordinary spun yarn. A knit structure of the glove with a two-layer structure on the back surface (skin side) was the same as that in Example 1. Note here that a fancy twist yarn 44 formed of cotton yarns had a fineness of 2513 dtex (cotton count: 2.35), and 2 spun yarns 43 of the above-described meta-aramid fiber of 590.5 dtex (cotton count: 10) were used.

The above-described two gloves were overlapped and bonded to each other with a heat-resistant adhesive ("Three Bond 1212" (trade name) manufactured by Three Bond Co., Ltd.) applied to five fingertip points 46*a* to 46*e* shown in FIG. 6C.

FIG. 6B is a cross-sectional view of the heat-resistant glove with a three-layer structure obtained as described above. From the surface side, the aramid fiber yarn 41, an air layer 45, the aramid fiber layer 43, and the layer 44 of large loops of the fancy twist yarn formed of cotton yarns were formed in this order. The single glove (for one hand) had a weight of 65 g. The ratio between the thickness of the aramid fiber layer (surface) and that of the cotton layer (back surface) was about 3:2.

The heat-resistant glove with a three-layer structure exhibited heat resistance that was between the heat resistance of the glove in Example 1 and that of the glove in Example 2. Further, no loop protruded through the surface of the glove as in the glove of Example 2, resulting in improved safety in use.

Example 4

Figure 7A:
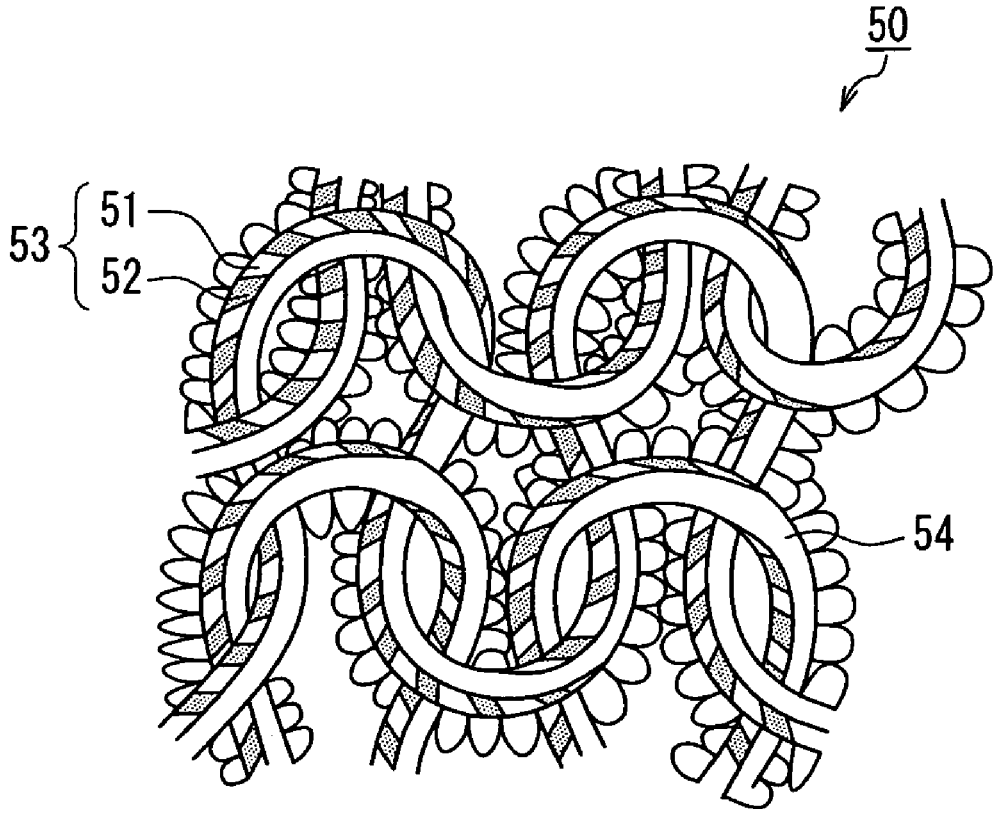
FIGS. 7A and 7B are a knitted fabric structure diagram and a schematic cross-sectional view, respectively, of a heat-resistant glove with a two-layer structure in which a carbon fiber and an aramid fiber are arranged on a surface layer.
Figure 7B:
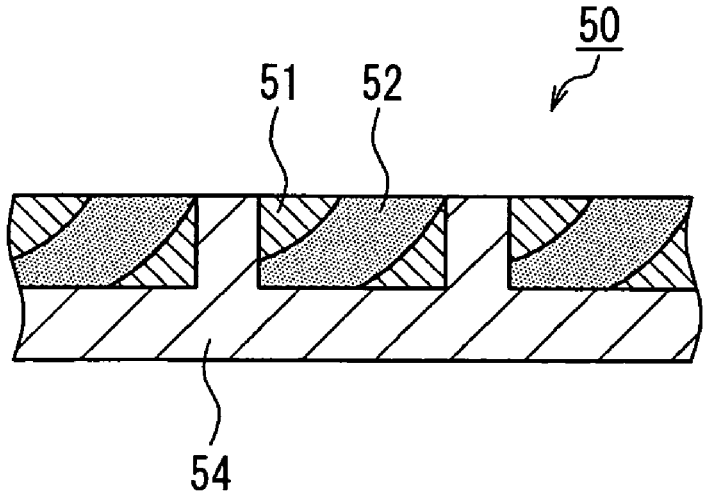

FIGS. 7A and 7B show an example of a heat-resistant glove 50 with a two-layer structure in which a carbon fiber and an aramid fiber are arranged on a surface layer. As shown in FIG. 7A, on the surface layer, a spun yarn 51 of the above-described meta-aramid fiber of 295.3 dtex (cotton count: 20) and a spun yarn 52 of a carbon fiber of 1181 dtex (cotton count: 5) ("Pyromex" (trade name) manufactured by Toho Rayon Co., Ltd.) were actually twisted at 2.5 turns/inch to form a twist yarn 53. A fancy twist yarn 54 formed of cotton yarns was arranged on a back surface (skin side). The fancy twist yarn had a fineness of 2513 dtex (cotton count: 2.35).

FIG. 7B is a cross-sectional view of the heat-resistant glove 50 obtained as described above. The aramid fiber yarn 51 and the carbon fiber 52 were arranged on a surface side, and a layer of large loops of the fancy twist yarn 54 formed of cotton yarns was formed on a back surface side. The single glove (for one hand) had a weight of 86 g. The ratio between the thickness of the surface layer formed of the aramid fiber and the carbon fiber and that of the back surface layer of the cotton loops was about 3:2.

Since the carbon fiber yarn and the aramid fiber yarn were twisted to be arranged on the surface of the heat-resistant glove, the glove had improved fire resistance and resistance to cutting, and was convenient to use with a hard texture as a whole.

Example 5

Figure 8A:
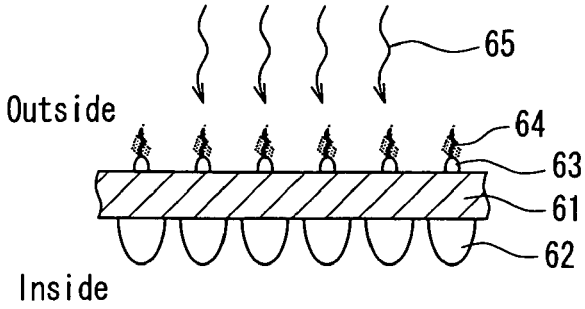
FIGS. 8A to 8D are explanatory diagrams showing a combustion test in Example 5 of the present invention.
Figure 8B:
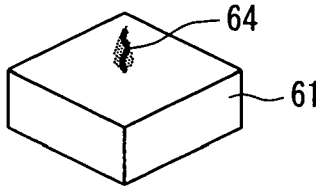
Figure 8C:
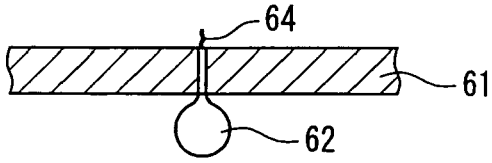
Figure 8D:
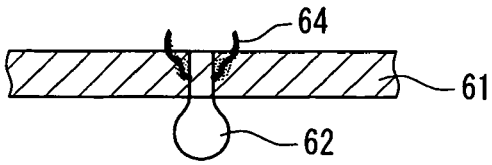
Figure 9A:
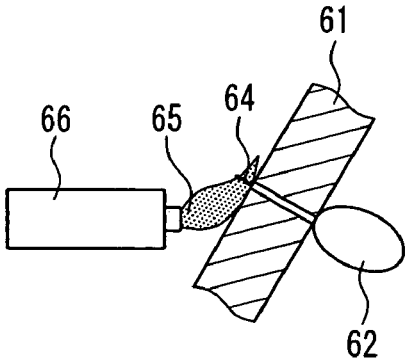
FIGS. 9A to 9C are explanatory diagrams showing the combustion test.
Figure 9B:
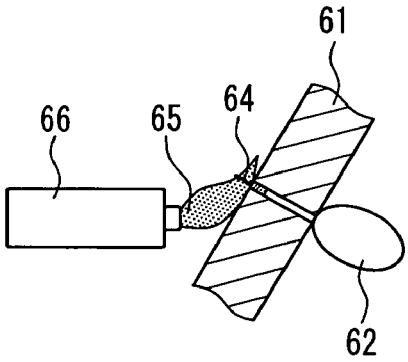
Figure 9C:
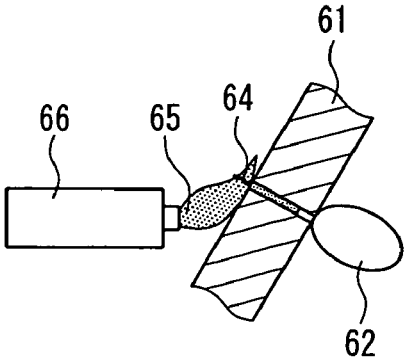

The heat resistant glove obtained in the present example was subjected to a combustion test in more detail. The heat-resistant glove was made in the same manner as in Example 1. FIGS. 8A to 8D show a horizontal combustion test, and FIGS. 9A to 9C show an oblique combustion test. A knit fabric subjected to the combustion test was a "palm" portion (area: 72 $cm^2$) cut from the glove. First, as shown in FIG. 8A, a knit fabric 61 was arranged such that a cotton fancy twist yarn 62 with loops was on an underside and an aramid fiber yarn was on a topside. Here, a small cotton loop 64 slightly protruded through a topside surface. When the knit fabric was exposed to a flame 65 of a nickel burner 66 at about 800° C. from above in accordance with "flammability test for fiber product" regulations in JIS-1091-1999, the small cotton loop 64 was combusted or got burned. The aramid fiber yarn was not changed only by a brief exposure to the flame. FIGS. 8B to 8D and 9A to 9C show a state in which the small cotton loop 64 was combusted or got burned. When the knit fabric 61 had a high knitting density, it was not fired inside by exposure to the flame as shown in FIGS. 8C and 9B. This was because combustion or burning was hindered by the use of the aramid fiber yarn whose limiting oxygen index (LOI), i.e., a minimum amount of oxygen expressed in volume fraction that is necessary to maintain combustion, was about 30. On the contrary, when the knit fabric 61 had a low knitting density, it was fired inside as shown in FIGS. 8D and 9C.

A combustion test was carried out for knit fabrics with different knitting densities. The results are shown in Table 1. The combustion test was carried out at Technology Research Institute of Osaka Prefecture in accordance with "flammability test for fiber product" regulations in JIS-1091.

TABLE 1

| Test No. | Weight of single glove (g) | Weight of palm portion (72 $cm^2$) (g) | Weight per square centimeter ($g/cm^{2)}$ | Flammability |
|---|---|---|---|---|
| 1 | 57.0 | 6.0 | 0.083 | Fired inside |
| 2 | 61.8 | 6.5 | 0.090 | Not fired inside |
| 3 | 70.3 | 7.4 | 0.103 | Not fired inside |
| 4 | 76.0 | 8.0 | 0.111 | Not fired inside |
| 5 | 85.5 | 9.0 | 0.125 | Not fired inside |
| 6 | 95.0 | 10.0 | 0.139 | Not fired inside |

From the above-described results of the combustion test, it was found that when the weight per square centimeter of the knitted fabric with a two-layer structure shown in Example 1 was 0.090 $g/cm^2$ or more, favorable flame resistance was obtained. Note here that even when the weight per unit area was not more than the above-mentioned value, favorable heat shielding properties were obtained.

Further, it was confirmed that the glove with a four-layer structure in Example 2 was not combusted even by exposure to the flame of the nickel burner at about 800° C. for two minutes since the cotton loop, which might serve as a fuse, did not protrude through a surface of the glove.

Example 6

Figure 10A:
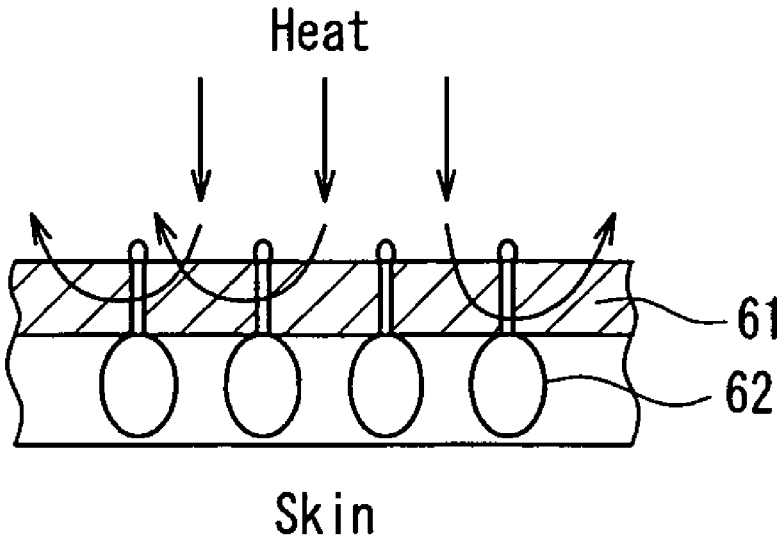
FIGS. 10A and 10B are cross-sectional views for explaining heat shielding properties of a heat-resistant glove in Example 6 of the present invention.
Figure 10B:
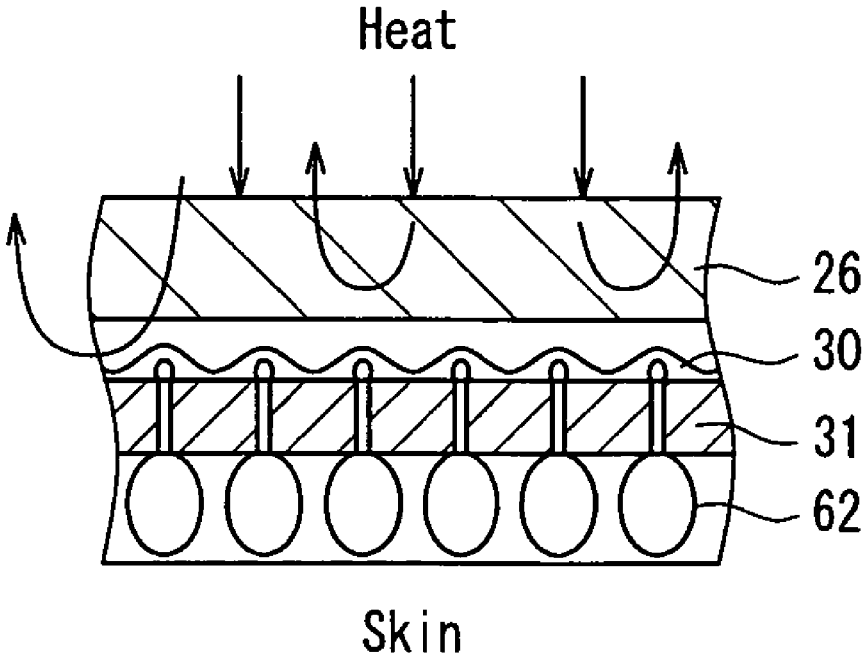

In the present example, a description will be given of heat shielding properties and resistance to cutting. FIGS. 10A and 10B are cross-sectional views for explaining the heat resistance of a fabric of the present invention. In the case of a heat-resistance glove with a two-layer structure (Example 1) shown in FIG. 10A, a cotton loop yarn 62 is arranged on a skin side, and a heat-resistant fiber yarn 61 is arranged on an outer side. Thus, a portion of the heat-resistant fiber yarn 61 blocks the entrance of heat. This is because the loop yarn 62 contains much air. The thermal conductivity of various materials was measured. The results are shown in Table 2. The thermal conductivity was measured with a KES-F7 (thermolab) device at Technology Research Institute of Osaka Prefecture.

TABLE 2

| Material | Thermal conductivity (w/mK) |
|---|---|
| Cotton | 0.243 |
| Water | 0.582 |

TABLE 2-continued

| Material | Thermal conductivity (w/mK) |
|---|---|
| Iron | 83.5 |
| Copper | 403.0 |
| Air | 0.021 |
| Heat-resistant glove in Example 1 | 0.085 |

As is evident from Table 2, the heat-resistant glove in Example 1 of the present invention had low thermal conductivity.

FIG. 10B is a cross-sectional view of a heat-resistant glove with a four-layer structure, in which an aramid fiber 26, a layer 30 of small loops of the aramid fiber, an aramid fiber layer 31, and a layer 62 of large loops of a fancy twist yarn formed of cotton yarns are formed in this order from an outer side. A portion of the heat-resistant fiber yarn 26 blocks the entrance of heat. Thus, the heat shielding properties were much higher than those of the glove with a two-layer structure shown in FIG. 10A.

Next, the heat-resistant glove in Example 1 of the present invention was subjected to the measurement of resistance to cutting. The resistance to cutting was measured at Technology Research Institute of Osaka Prefecture in accordance with "constant rate of specimen extension test" regulations in JIS-1096, bursting strength B-method, in the following manner: a knife (OLFA SDS-7) was attached to an end of a pushing rod, and a sample was cut with the knife in a stabbing manner at a rate of 2 cm/min, whereby the strength of cutting was measured. As a comparative example, a commercially available heat-resistant leather glove, which was said to have excellent resistance to cutting, was subjected to the measurement. The results are shown in Table 3.

TABLE 3

| Name of sample | Resistance to cutting (kgf) |
|---|---|
| Leather glove | 0.50 |
| Heat-resistant glove in Example 1 | 0.95 |

As shown in Table 3, the heat-resistant glove in Example 1 of the present invention had higher resistance to cutting than that of the commercially available heat-resistant leather glove. This was because the heat-resistant glove in Example 1 included an aramid fiber.

Example 7

(1) Manufacture of Fancy Twist Yarn

A polyester multifilament textured yarn (manufactured by Toray Industries. Inc.) composed of 75 filaments with a total fineness of 166.7 dtex (150 denier) was used as a core yarn and a holding yarn, and a cotton yarn of 196.9 dtex (cotton count: 30) was used as a loop yarn. 2 to 3 single yarns of cotton were overfed at a rate 5 to 7 times as high as that of a single core yarn so as to be intertwined therewith, and at the same time as the intertwining, the holding yarn was actually twisted from above the intertwined yarns at about 1000 turns/m. The thus obtained fancy twist yarn had protruding loops, each having an average length of 3 mm, and 70 loops per inch on average protruded at all angles in a 360° range as shown in FIGS. 1A and 1B. This fancy twist yarn had a fineness of 2511 dtex (cotton count: 2.3530, 2260 denier).

(2) Preparation of Heat-Resistant Fiber Yarn 8 or 9 commercially available spun yarns, "CONEX" (trade name) (meta-aramid fiber) manufactured by Teijin Ltd., of 295.3 dtex (cotton count: 20) were used.

(3) Knitting of Fabric and Sewing into Garment

Figure 12A:
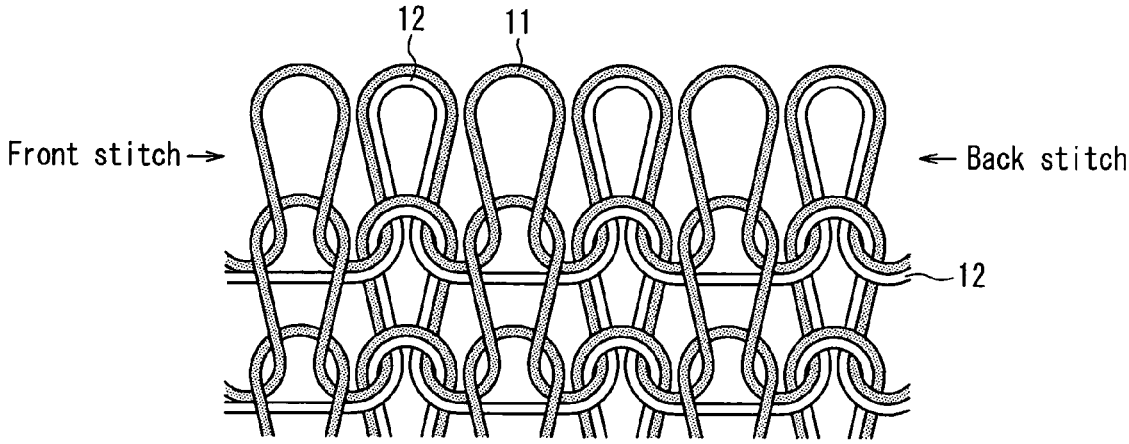
FIGS. 12A and 12B are structure diagrams of a fraise double knit fabric formed in Example 7 of the present invention.
Figure 12B:
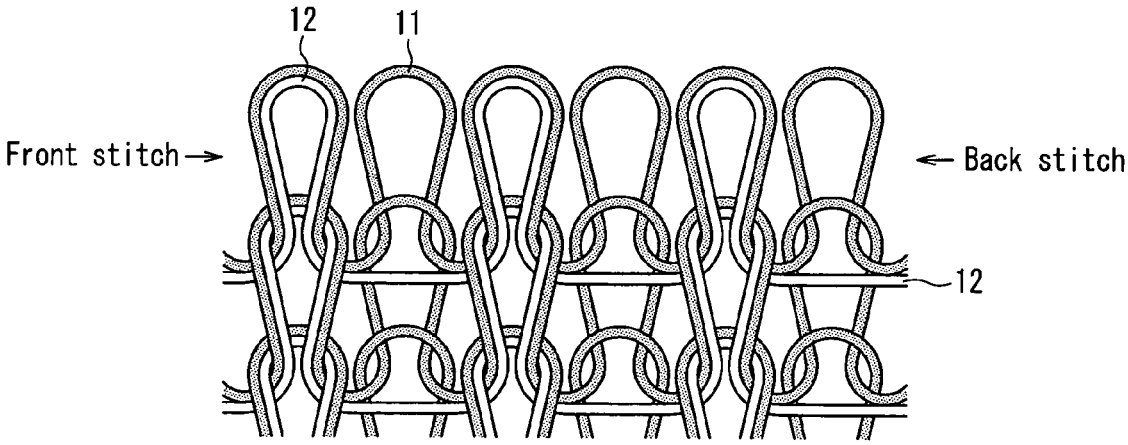

By using a fraise flat knitting machine, a fabric was knitted in accordance with a basic structure shown in FIGS. 12A and 12B. FIGS. 12A and 12B show a fraise pattern. A yarn 11 was an aramid fiber yarn that constituted all the stitches, and a fancy twist yarn 12 was knitted along the yarn 11 every other loop. The thus obtained knitted fabric had a weight per unit area of 650 g/m$^2$. The knitted fabric was sewed into a parka for men with front stitches of the knitted fabric as a back surface of the garment and back stitches of the knitted fabric as a surface of the garment.

(4) Trial

When the above-described parka was subjected to a wear trial, it was warm and comfortable to wear. The parka had the same heat resistance as that in Example 1. Further, when the parka was cut with a cutter knife, it was not cut off, exhibiting high protection.

Example 8

Figure 13:
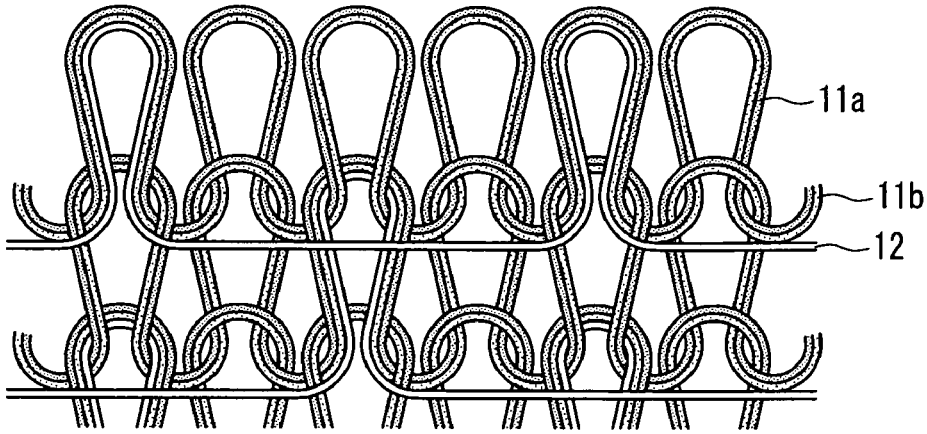
FIG. 13 is a structure diagram of a single 3-stitch skip fleecy knit fabric formed in Example 8 of the present invention.
Figure 13:
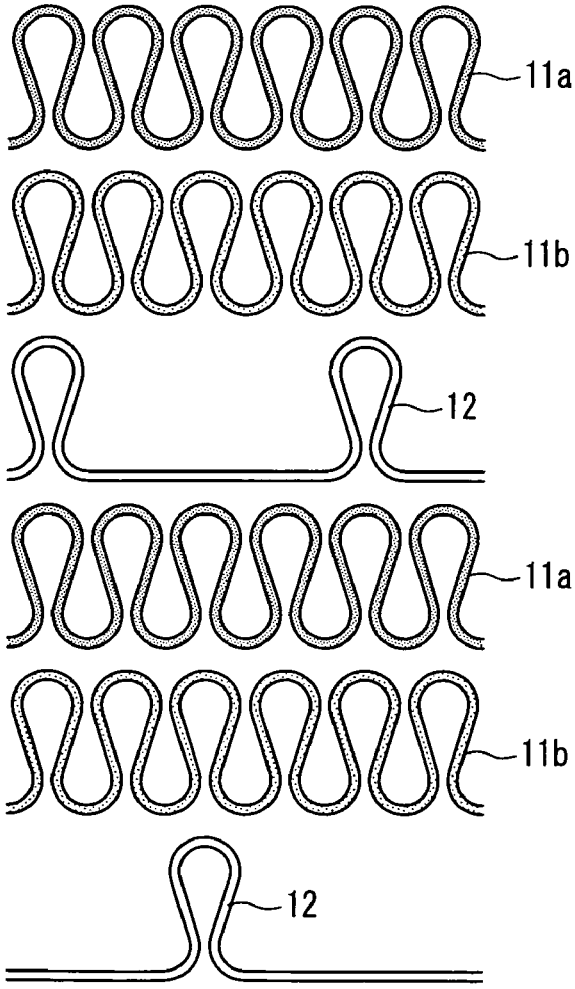

A fancy twist yarn and a heat-resistant fiber yarn were prepared in the same manner as in Example 7 except that the fancy twist yarn was formed of wool yarns (138.4 dtex, wool count: 64) instead of cotton yarns, and a single 3-stitch skip fleecy fabric was knitted in accordance with a knit structure shown in FIG. 13. In FIG. 13, an upper diagram shows a knit structure, and a lower diagram shows the movement of each of the constituent yarns. Reference numerals 11*a* and 11*b* denote aramid fiber yarns, and 12 denotes the fancy twist yarn. The thus obtained knitted fabric had a weight per unit area of 530 g/m$^2$. The knitted fabric was sewed into a jumper. When the jumper was subjected to a wear trial, it was warm and comfortable to wear. The jumper had the same heat resistance as that in Example 1. Further, when the jumper was cut with a cutter knife, it was not cut off, exhibiting high protection.

Example 9

Figure 14:
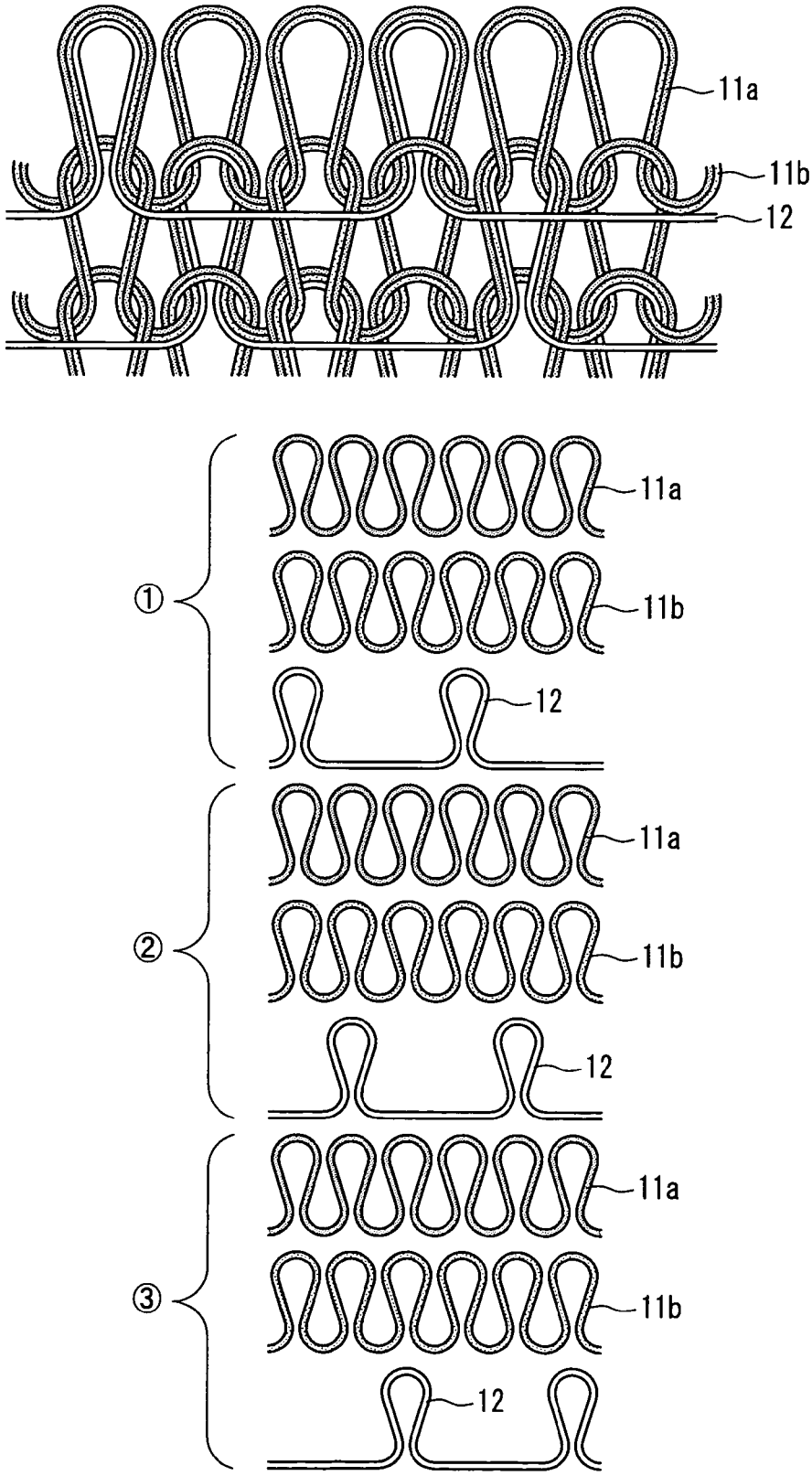
FIG. 14 is a structure diagram of a single 2-stitch skip fleecy knit fabric formed in Example 9 of the present invention.

A fancy twist yarn and a heat-resistant fiber yarn were prepared in the same manner as in Example 7 except that the fancy twist yarn was formed of wool yarns (184.5 dtex, wool count: 48) instead of cotton yarns, and a single 2-stitch skip fleecy fabric was knitted in accordance with a knit structure shown in FIG. 14. In FIG. 14, an upper diagram shows a knit structure, and lower diagrams (1) to (3) show a pattern and the movement of each of the constituent yarns. Reference numerals 11*a* and 11*b* denote aramid fiber yarns, and 12 denotes the fancy twist yarn. The thus obtained knitted fabric had a weight per unit area of 450 g/m$^2$. The knitted fabric was sewed into a jacket. When the jacket was subjected to a wear trial, it was warm and comfortable to wear. This vest had the same heat resistance as that in Example 1. Further, when the jacket was cut with a cutter knife, it was not cut off, exhibiting high protection.

The invention claimed is:

1. A heat-resistant fabric as a knitted or woven fabric including a heat-resistant fiber yarn and a fancy twist yarn, wherein the heat-resistant fiber yarn is present more on one surface, and the fancy twist yarn is present more on the other surface, the fancy twist yarn is formed of a core yarn, a loop yarn, and a holding yarn, and the loop yarn is formed of at least one selected from the group consisting of cotton, rayon, hemp, wool, and an acrylic fiber.

2. The heat-resistant fabric according to claim 1, wherein the heat-resistant fiber yarn is formed of at least one selected from the group consisting of an aramid fiber, a polybenzimidazole fiber, a polybenzoxazole fiber, a polybenzthiazole fiber, a polyamide imide fiber, a melamine fiber, a polyimide fiber, a polyarylate fiber, and a carbon fiber.

3. The heat-resistant fabric according to claim 1, having at least one structure selected from the group consisting of a double knit, a double jersey, an interlock knit fabric, a double raschel, a double knitted fabric, a double cloth, a single knit, and a smooth knitted fabric.

4. A garment in part or in entirety including a heat-resistant fabric as a knitted or woven fabric including a heat-resistant fiber yarn and a fancy twist yarn, wherein the heat-resistant fiber yarn is present more on one surface, and the fancy twist yarn is present more on the other surface, the fancy twist yarn is formed of a core yarn, a loop yarn, and a holding yarn, and the loop yarn is formed of at least one selected from the group consisting of cotton, rayon, hemp, wool, and an acrylic fiber.

5. The garment according to claim 4, having a weight per unit area in a range of 300 to 700 g/m$^2$.

6. A heat-resistant glove formed of a knitted fabric including a heat-resistant fiber yarn and a fancy twist yarn, wherein the knitted fabric is a knit, the heat-resistant fiber yarn is present more on an outer surface, and the fancy twist yarn is present more on an inner surface, the fancy twist yarn is formed of a core yarn, a loop yarn, and a holding yarn, and the loop yarn is formed of at least one selected from the group consisting of cotton, rayon, hemp, wool, and an acrylic fiber.

7. A heat-resistant glove with a multilayer structure comprising:

on an inner side, a heat-resistant glove formed of a knitted fabric including a heat-resistant fiber yarn and a fancy twist yarn, wherein the knitted fabric is a knit, the heat-resistant fiber yarn is present more on an outer surface, and the fancy twist yarn is present more on an inner surface, the fancy twist yarn is formed of a core yarn, a loop yarn, and a holding yarn, and the loop yarn is formed of at least one selected from the group consisting of cotton, rayon, hemp, wool, and an acrylic fiber; and on an outer side, a glove formed of a heat-resistant fiber yarn, wherein both the gloves are fixed at fingertip points.

8. The heat-resistant glove according to claim 6, wherein the heat-resistant fiber yarn on the outer side is an aramid fiber yarn or a twist yarn formed of an aramid fiber yarn and a carbon fiber.

9. The heat-resistant glove according to claim 6, having a weight per unit area of not less than 0.09 g/cm$^2$.

10. The heat-resistant glove according to claim 7, wherein the heat-resistant fiber yarn on the outer side is an aramid fiber yarn or a twist yarn formed of an aramid fiber yarn and a carbon fiber.

11. The heat-resistant glove according to claim 7, having a weight per unit area of not less than 0.09 g/cm$^2$.

12. The heat-resistant fabric according to claim 1, having a weight per unit area in a range of 300 to 700 g/m$^2$.

13. The garment according to claim 4, wherein the heat-resistant fiber yarn is formed of at least one selected from the group consisting of an aramid fiber, a polybenzimidazole fiber, a polybenzoxazole fiber, a polybenzthiazole fiber, a polyamide imide fiber, a melamine fiber, a polyimide fiber, a polyarylate fiber, and a carbon fiber.

14. The garment according to claim 4, wherein the heat-resistant fabric has at least one structure selected from the group consisting of a double knit, a double jersey, an interlock knit fabric, a double raschel, a double knitted fabric, a double cloth, a single knit, and a smooth knitted fabric.

15. The heat-resistant glove according to claim 6, wherein the heat-resistant fiber yarn is formed of at least one selected from the group consisting of an aramid fiber, a polybenzimidazole fiber, a polybenzoxazole fiber, a polybenzthiazole fiber, a polyamide imide fiber, a melamine fiber, a polyimide fiber, a polyarylate fiber, and a carbon fiber.

16. The heat-resistant glove according to claim 6, wherein the heat-resistant fabric has at least one structure selected from the group consisting of a double knit, a double jersey, an interlock knit fabric, a double raschel, a double knitted fabric, a double cloth, a single knit, and a smooth knitted fabric.

17. The heat-resistant glove according to claim 7, wherein the heat-resistant fiber yarn is formed of at least one selected from the group consisting of an aramid fiber, a polybenzimidazole fiber, a polybenzoxazole fiber, a polybenzthiazole fiber, a polyamide imide fiber, a melamine fiber, a polyimide fiber, a polyarylate fiber, and a carbon fiber.

18. The heat-resistant glove according to claim 7, wherein the heat-resistant fabric has at least one structure selected from the group consisting of a double knit, a double jersey, an interlock knit fabric, a double raschel, a double knitted fabric, a double cloth, a single knit, and a smooth knitted fabric.

* * * * *